US006350146B1

(12) United States Patent
Su

(10) Patent No.: US 6,350,146 B1
(45) Date of Patent: Feb. 26, 2002

(54) CABLE CONNECTOR ASSEMBLY

(75) Inventor: Ping-Sheng Su, Tu-Chen (TW)

(73) Assignee: Hon Hai Precision Ind. Co, Ltd., Taipei Hsien (TW)

( * ) Notice: Subject to any disclaimer, the term of this patent is extended or adjusted under 35 U.S.C. 154(b) by 0 days.

(21) Appl. No.: 09/679,497

(22) Filed: Oct. 3, 2000

(30) Foreign Application Priority Data

Apr. 25, 2000 (TW) ..... 89107761 A

(51) Int. Cl.[7] ..... H01R 4/24
(52) U.S. Cl. ..... 439/427
(58) Field of Search ..... 439/427, 610, 439/607–609

(56) References Cited

U.S. PATENT DOCUMENTS 4,352,240 A * 10/1982 Komada ..... 439/427
4,902,242 A * 2/1990 Davis et al. ..... 439/404
5,755,589 A * 5/1998 Koch ..... 439/427
5,775,934 A * 7/1998 McCarthy ..... 439/427

* cited by examiner

*Primary Examiner*—Gary F. Paumen
(74) *Attorney, Agent, or Firm*—Wei Te Chung

(57) ABSTRACT

A cable connector assembly includes a cable connector 1 and a cable 6. The cable connector includes a connector body 3, a retention frame 7, a retention body 2 and a conductive body 8. Each wire of the cable includes an insulation layer 61 surrounding a plurality of metal conductor threads 62 therein. The retention body defines a plurality of tapered passageways 20 therethrough. The connectorbody has an insulative housing 14 comprising a plurality of contacts 5. Each contact 5 is formed with a tapered portion 52 for piercing into the passageway 20 along a lengthwise direction of the wire to engage with and expand the wire. The insulation is expanded by the tapered portion of the contact to securely engage with the retention block.

1 Claim, 6 Drawing Sheets

CABLE CONNECTOR ASSEMBLY

BACKGROUND OF THE INVENTION

1. Field of the Invention

The present invention relates to a cable connector assembly, and particularly to a cable connector assembly having a plurality of tapered contacts for easily and reliably assembling to a cable.

2. Description of the Prior

It is well known that a cable connector has a plurality of contacts connected with a plurality of wires of a cable for electrical signal transmission. Generally speaking, two conventional methods are used for attaching the wires to corresponding contacts. A first method is shown in FIG. 5. A plurality of core wires 91 is attached to corresponding contacts 92 of a cable connector 90 using a soldering process. During the soldering process, solder is used to connect the contacts and the wires of the cable together. However, the solder consists of tin and lead, and lead is harmful to human health. Furthermore, the soldering process is complicated and is not suited for mass production.

An alternative conventional assembling method to connect a cable connector with a cable is by insulation displacement contact (IDC). Such a method is disclosed in U.S. Pat. No. 4,902,242. Referring to FIG. 6, a cable connector 100 comprises a plurality of IDC contacts 102. Each contact 102 comprises a V-shaped engaging portion for piercing an outer insulation layer 104 of a corresponding wire 103 and then electrically connecting with a corresponding metallic core 105. However, the connection between the contacts of the cable connector and corresponding wires 103 requires that each IDC type contact should be placed at a relatively precise position; therefore, the assembly process is complicated and the connection is not reliable.

Thus, there is a need for a cable connector which can be easily and reliably assembled with a cable.

BRIEF SUMMARY OF THE INVENTION

A main object of the present invention is to provide a cable connector assembly having a plurality of tapered contacts for piercing into corresponding wires of a cable, whereby the wires reliable electrically connect with the contacts and the assembly process is simplified.

Another object of the present invention is to provide a method for easily and reliably assembling a plurality of wires of a cable to a cable connector.

To fulfill the above-mentioned objects, according to a preferred embodiment of the present invention, a cable connector assembly comprises a cable connector and a cable. The cable connector comprises a connector body, a retention frame, a retention body and a conductive body. The retention body is received within the retention frame, which in turn is received in a chamber of the conductive body. An insulative housing of the connector body defines a plurality of passageways therethrough for retaining corresponding contacts therein. The retention block comprises a plurality of tapered passageways therein. The cable comprises a plurality of wires each comprising an insulation layer enveloping a number of metal conductor threads. Ends of the wires are placed into corresponding tapered passageways. Each contact is formed with a tapered portion for piercing into a tapered passageway of the retention body along a lengthwise direction of the wire to engage and push apart the conductor threads wires. The insulation layer is expanded by the tapered portion of the contact to securely engage with the retention block. The retention body comprises a plurality of tapered passageways therein.

Other objects, advantages and novel features of the invention will become more apparent from the following detailed description when taken in conjunction with the accompanying drawings.

DETAILED DESCRIPTION OF THE INVENTION

Figure 1:
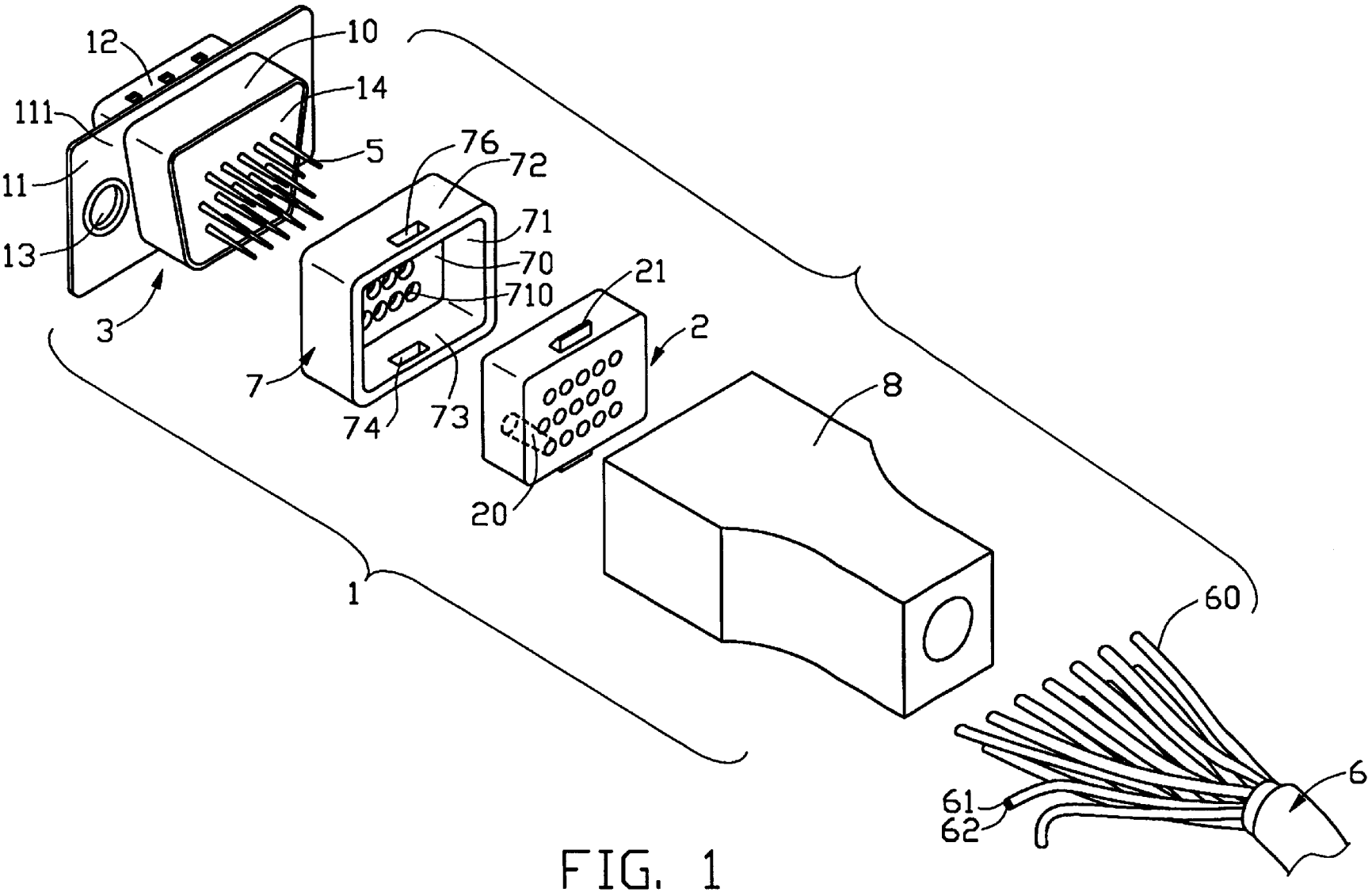
FIG. 1 is a perspective, exploded view of a cable connector in accordance with the present invention and a cable to be connected to the connector.
Figure 2:
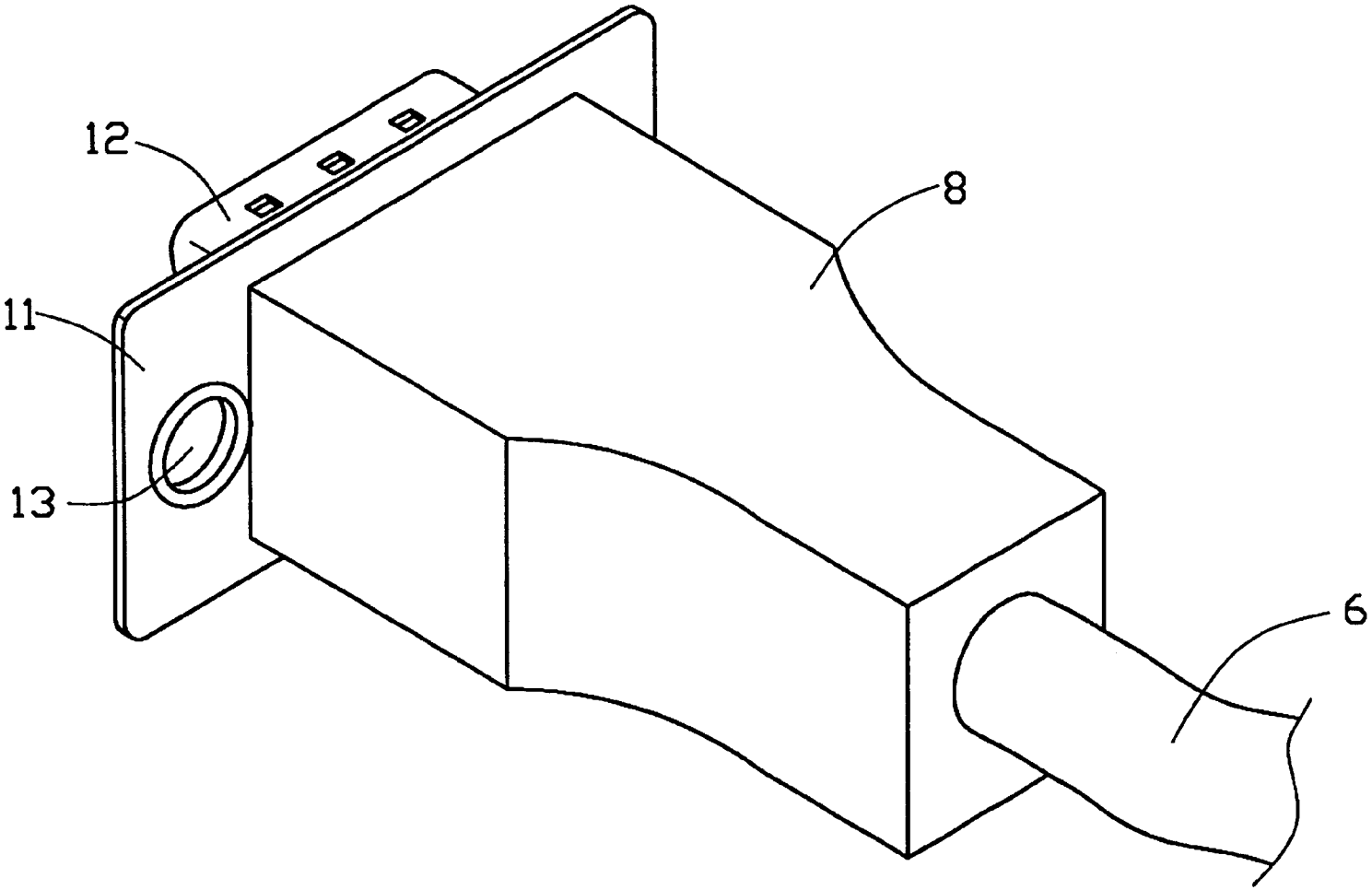
FIG. 2 is a perspective view of the assembled cable connector and cable of FIG. 1.

Referring to FIGS. 1–2, a cable connector assembly comprises a cable connector 1 and a cable 6. The cable connector 1 consists of a connector body 3, a retention body 2, a retention frame 7 and a conductive body 8. The connector body 3 comprises a conductive shielding 11 having a front shroud 12 and a rear shroud 10 respectively forwardly and rearwardly extending from a front side (not labeled) and a rear side (not labeled) of a metal sheet 111. A circle hole 13 is formed at both sides of the metal sheet 111 whereby bolts (not shown) can be used to extend through the metal sheet 111 to threadedly engage with a mating connector to securely connect the connector assembly in accordance with the present invention with the mating connector, and to achieve a grounding connection therebetween. An insulative housing 14 is received in the shielding 11 and defines a plurality of passageways therethrough for receiving corresponding contacts 5 therein.

The retention body 2, having the shape of a rectangular block, defines a plurality of tapered passageways 20 therethrough. Each tapered passageway 20 corresponds to a contact 5 of the connector body 3. A pair of retention blocks 21 are respectively formed on a top and a bottom surfaces (not labeled) of the retention body 2.

The retention frame 7 comprises a rectangular front portion 70 with elongate top and bottom portions 72, 73 respectively extending perpendicularly top and bottom edges thereof. A pair of side portions (not labeled) respectively extend rearward from side edges of the front portion 70. The front portion 70, top portion 72, bottom portion 73 and side portion together define a receiving space 71 for accommodating the retention body 2 therebetween. A top and bottom portion 72, 73 of the retention frame 7 each define a retention hole 76, 74 therethrough for engaging with a corresponding retention block 21 of the retention body 2. A front portion 70 of the retention frame 7 defines a plurality of holes 710 for extension of the contacts 5 therethrough when the connector 1 is assembled.

The cable 6 comprises an insulative outer sheath (not labeled) enclosing a plurality of wires 60 therein. Each wire 60 comprises an insulation layer 61 enclosing a plurality of metal conductor threads 62 therein.

Figure 3:
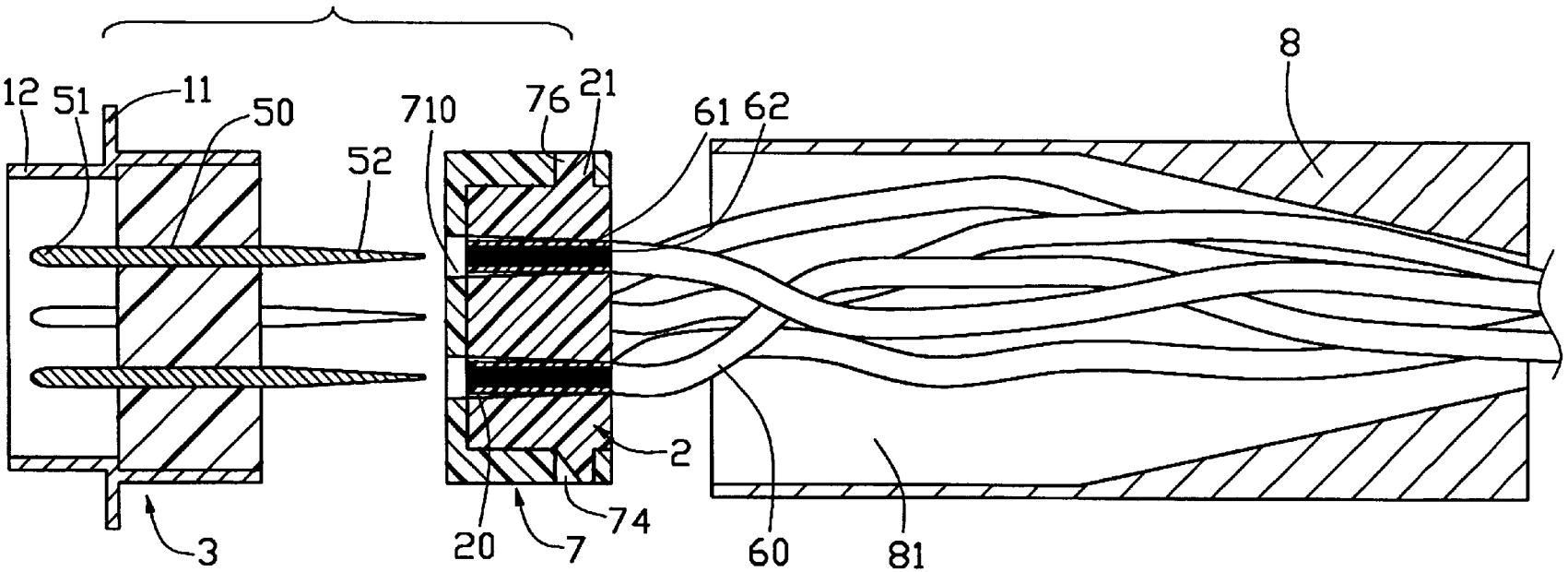
FIG. 3 is a cross-sectional view showing the cable connector and the cable in a semi-assembled state.
Figure 4:
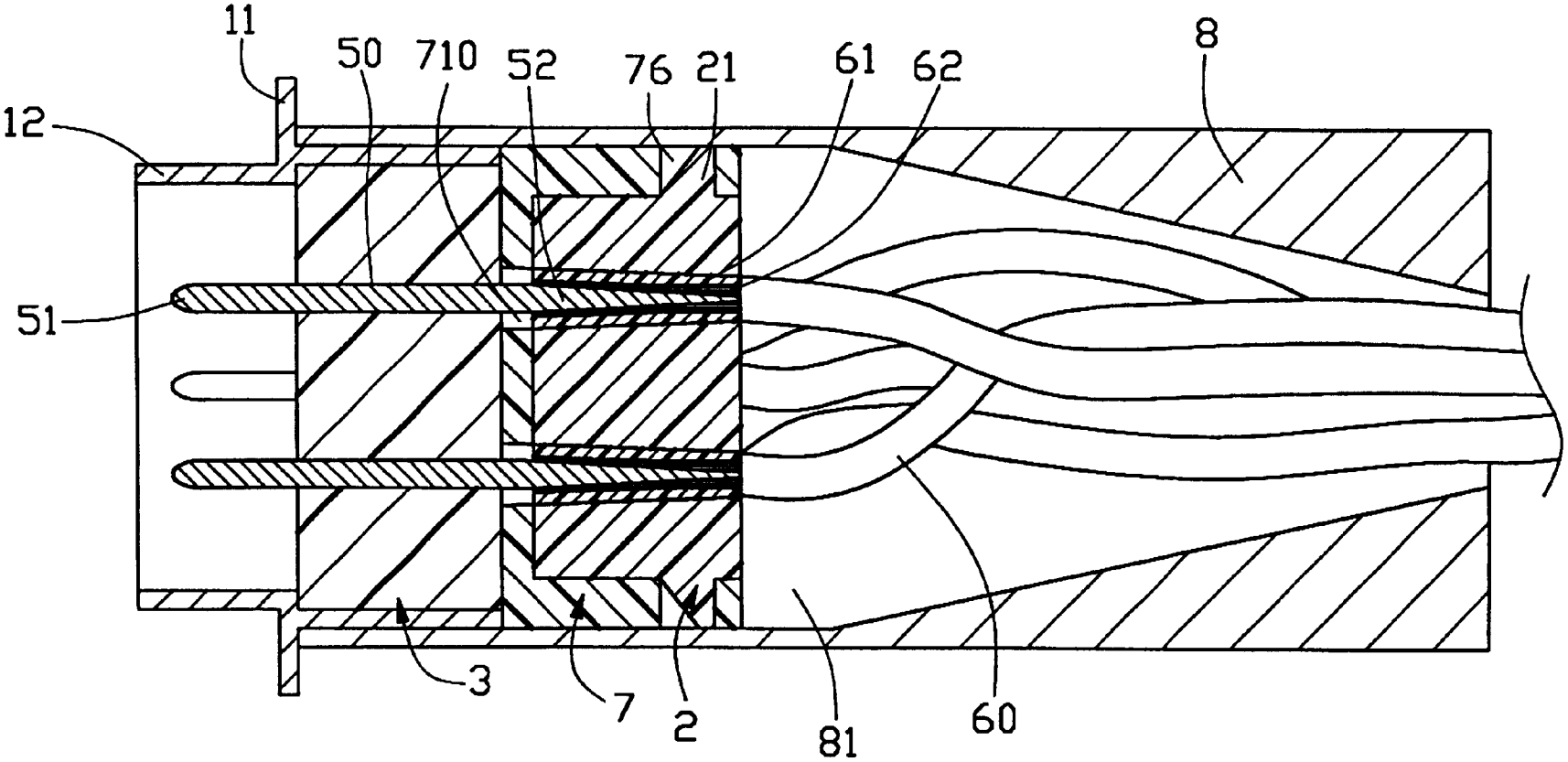
FIG. 4 a cross-sectional view showing the connector and the cable being completely assembled.
Figure 5:
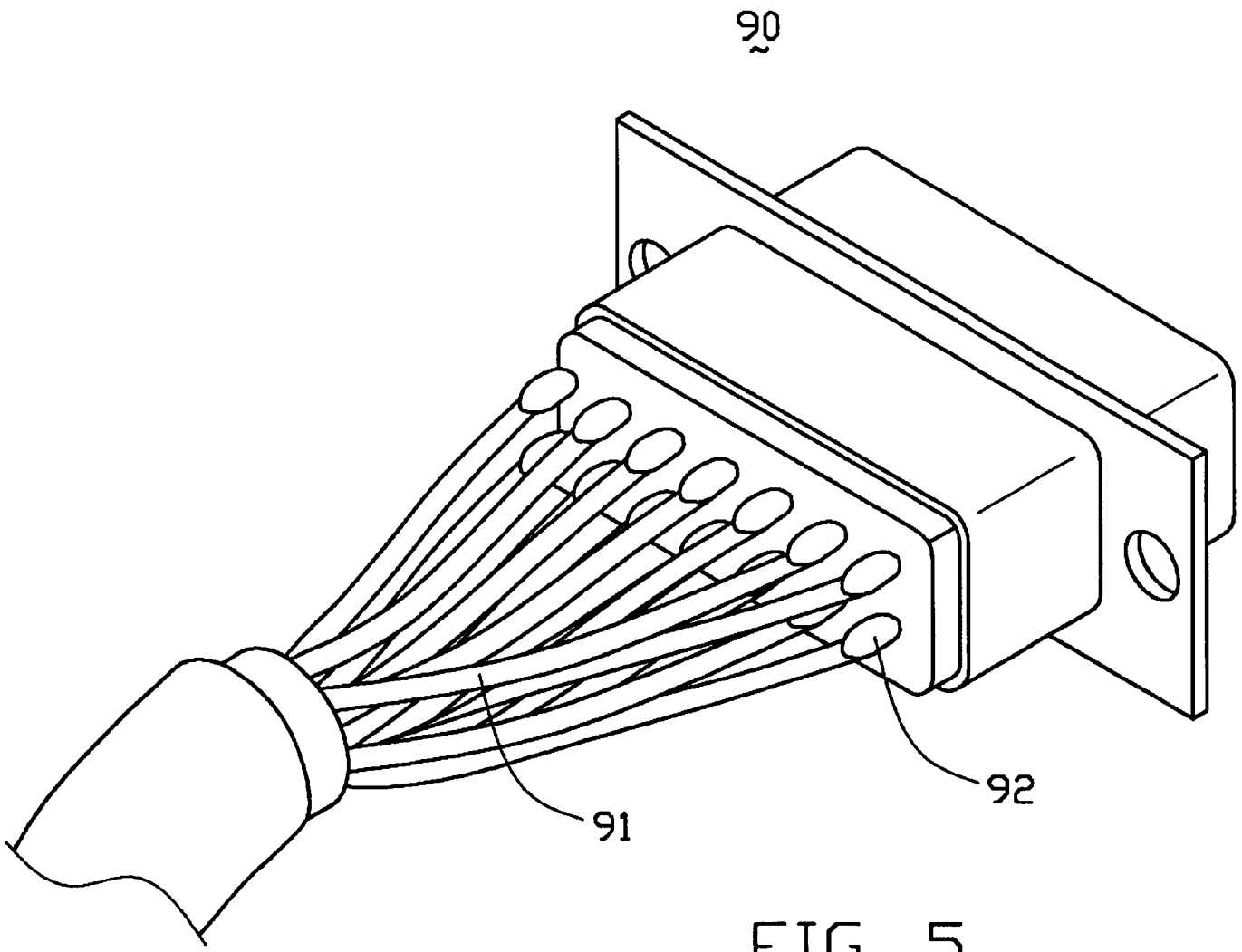
FIG. 5 PRIOR ART
FIG. 5 is a perspective view of a conventional cable connector and a cable soldered to the connector.
Figure 6:
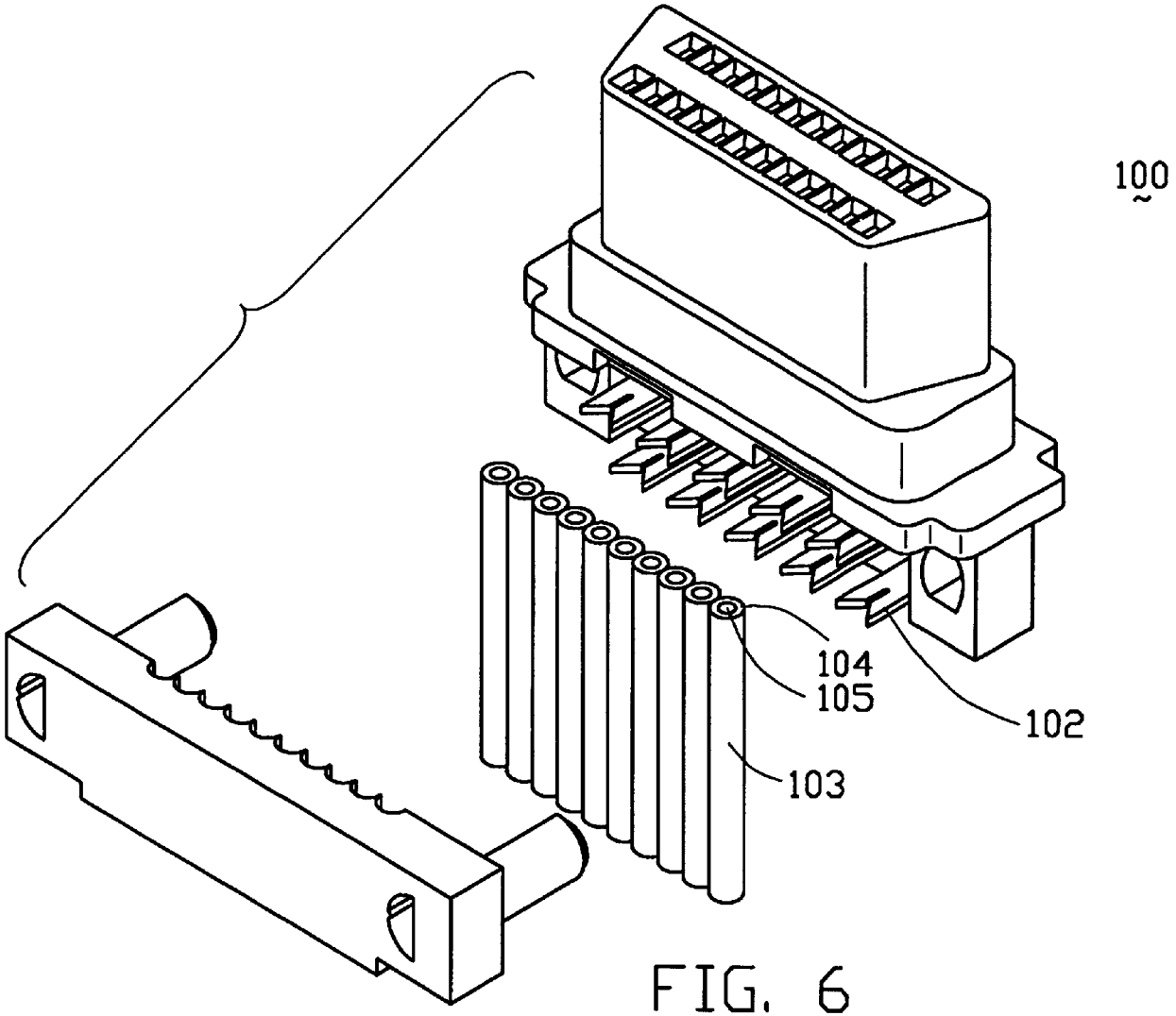
FIG. 6 PRIOR ART
FIG. 6 is a perspective view of an alternative conventional cable connector and a cable to be connected to the connector by IDC.

Referring to FIGS. 3–4, each wire 60 and the smaller portion of each tapered passageway 20 have substantially the same diameter. Each contact 5 comprises a front portion 51 and a middle portion 50 both having substantially the same diameter, and a rear tapered portion 52 extending rearwardly from the middle portion. The middle portion 50 is secured in the insulative housing 14. The front portion 51 extends beyond the housing 14 into a space surrounded by the front shroud 12 for engaging with a mating connector.

During assembly, a length of the insulative outer sheath of the cable 6 is peeled off, exposing the wires 60. The wires 60 are extended through the conductive body 8 and received in corresponding tapered retention passageways 20. The tapered portion 52 of each contact 5 penetrates a guidance hole 710 of the retention frame 7, which is axially aligned with the corresponding retention passageway 20, and thus axially pierces into a corresponding wire 60 located in a tapered passageway 20 of the retention body 2 to engage with and push apart the metal conductor threads 62, whereby the insulation 61 of the wire expands against an inner surface of the tapered passageway to a tight engagement with the retention body 2. The assembly process of the present invention is relatively simplified, and the wires 60 are reliably connected with the contacts 5. Thus, after assembly, the retention body 2, the retention frame 7 and the rear part of the connector body 3 are all snugly received in the chamber 81 of the conductive body 8. The end part of the wires 60 are also securely retained in the conductive body 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable connector comprising:

a connector body including a metal sheet forming a front shroud and a rear shroud respectively extending from a front side and a rear side thereof;

an insulative housing received in the conductive shielding and defining a plurality of passageways therethrough; and a plurality of contacts received in the passageways, each contact defining a front portion, a middle portion and a tapered rear portion;

an insulative retention body in the shape of rectangular block, defining a plurality of tapered passageways for receiving the rear portion of each contact therein; and an insulative retention frame comprising a front portion with a tip portion and a bottom portion extending perpendicularly from top and bottom edges of the front portion, the front portion, top portion and bottom portions together defining a receiving space for accommodating the retention body therein, the front portion having a plurality of holes therethrough for allowing passage of the contacts therethough; and a cable comprising a plurality of wires contained within an insulative outer sheath, each wire having an insulation layer and a plurality of metal conductor threads therein;

wherein each tapered contact rear portion axially pierces a corresponding wire and pushes metal threads of each wire apart to engage with the tapered passageway;

wherein an end part of the insulative outer sheath of the cable is peeled off to expose ends of the plurality of wires therein;

wherein the retention frame defines a pair of retention holes in the top portion and in the bottom portion thereof;

wherein the retention body defines a pair of retention blocks respectively extending from a top and a bottom side for engaging with corresponding retention holes of the retention frame.

* * * * *